United States Patent [19]

Nagamoto et al.

[11] 4,344,103

[45] Aug. 10, 1982

[54] ELECTROMAGNETIC RELAY

[75] Inventors: Mitsuki Nagamoto, Tsu; Nobuo Kobayashi, Ise, both of Japan

[73] Assignees: Matsushita Electric Works, Ltd., Osaka, Japan; Hans Sauer, Deisenhofen, Fed. Rep. of Germany

[21] Appl. No.: 219,832

[22] Filed: Dec. 24, 1980

[30] Foreign Application Priority Data

Apr. 10, 1980 [JP] Japan ..... 55-47226

[51] Int. Cl.[3] ..... H01H 51/22

[52] U.S. Cl. ..... 361/160; 335/133; 335/202

[58] Field of Search ..... 361/131, 160; 335/133, 335/129, 128, 106, 107, 202, 203

[56] References Cited

U.S. PATENT DOCUMENTS

| | | | |
|---|---|---|---|
| 3,559,132 | 1/1971 | Bernier | 335/203 |
| 4,206,432 | 6/1980 | Altorfer et al. | 335/202 |
| 4,260,973 | 4/1981 | Berthel et al. | 335/133 |

*Primary Examiner*—Harold Broome

*Attorney, Agent, or Firm*—Burns, Doane, Swecker & Mathis

[57] ABSTRACT

Electromagnetic relay comprising an electric switching block wherein fixed contact terminals, movable contactor terminal and coil terminals of respective switch sections are integrally held as embedded in an array along respective both longitudinal side edges of an elongated insulative base, and an electromagnet block mounted on the switching block base between the respective terminal arrays for driving their movable contactors by a rocking armature end or ends electromagnetically operated. At least contact holding parts of each pair of the fixed contact terminals are disposed in opposing relation to each other, whereby both side movable contacts of the movable contactor are disposed at the same distance positions from an end joined to the movable contactor terminal, while other terminal pin ends of the fixed contact terminals are disposed out of the opposing relation.

13 Claims, 21 Drawing Figures

Fig. 1
PRIOR ART
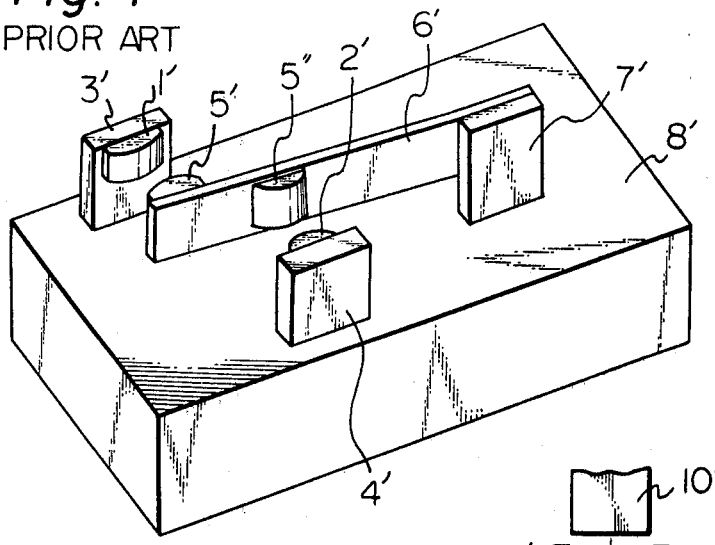
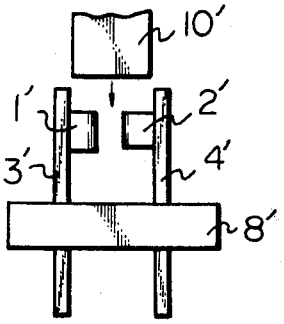
Fig. 2
PRIOR ART
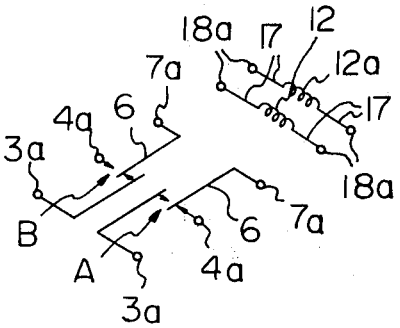
Fig. 4

Fig. 10
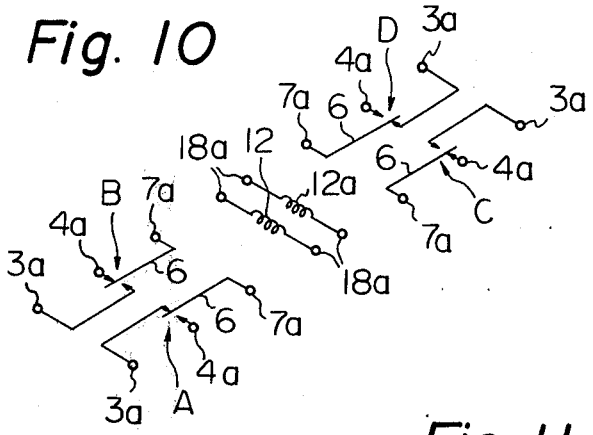
Fig. 11A
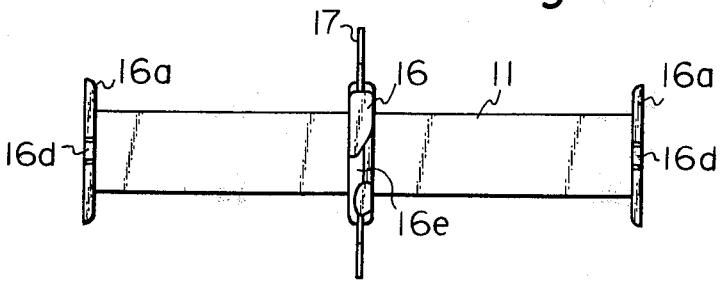
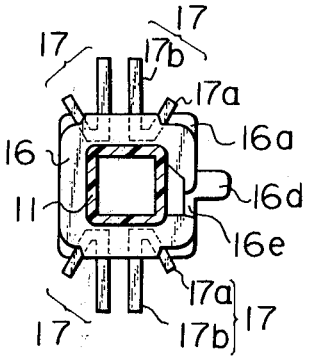
Fig. 11B

ELECTROMAGNETIC RELAY

This invention relates generally to electromagnetic relays and, more particularly, to improvements in such electromagnetic relays as, for example, polarized electromagnetic relays which comprising an electromagnet block and an electric switching block.

In conventional electromagnetic relays of the kind referred to in which respective terminals of a plurality of switch sections each including a pair of normally-opened (NO) and normally-closed (NC) side fixed contact terminals and a movable contact terminal as well as terminals for electromagnetic coil or coils are integrally embedded in a base body of an insulative material molded, typically, the pair of fixed contacts 1' and 2' as well as their terminals 3' and 4' are, as schematically shown in FIG. 1, deviated from each other so as not to oppose each other and a pair of movable contacts 5' and 5'' on both surfaces of a movable contactor spring plate 6' secured at a base end to a movable contact terminal 7 are also deviated from one another so as to be engageable with each of such deviated fixed contacts 1' and 2', respectively. This is for reason that, if the fixed contacts 1' and 2' are opposed to each other, an upper die 10' normally required for molding the base body 8' cannot be used since the both contacts 1' and 2' which are generally opposing through a very small distance are in the way of downward stroke of the upper die and the integral holding of the terminals with the molding made base body becomes practically impossible but, when the fixed contact terminals 3' and 4' are deviated as in the foregoing, the base body 8' can be made by using split dies of side core type. On the other hand, there has been a problem in the above arrangement that, as the movable contacts 5' and 5'' are disposed as deviated at positions mutually different in the distance from the base end of the movable contactor spring plate 6', the resiliency constant of the spring plate at each position of the NO and NC side movable contacts 5' and 5'' is caused to be different from each other so that a non-uniformity will arise in the contacting pressure of the respective movable contacts 5' and 5'' with the fixed contacts 1' and 2', whereby uniform reliability of contacting performance on both of the NO and NC sides cannot be achieved and hence the switching performances of the entire relay are deteriorated.

The present invention has been suggested to remove such problems as in the foregoings of the conventional electromagnetic relays of the kind referred to.

A primary object of the present invention is, therefore, to provide an electromagnetic relay which achieves a uniform contact pressure on both of the NO side and NC side contact points and is still easy to manufacture specifically in respect of the electric switching block in which the respective contact terminals are integrally held in a molding made base body.

A related object of the present invention is to provide an electromagnetic relay which is high in assembling easiness and reliability of the electromagnet block with the electric switching block of a structure high in the switching performances and still in the manufacturing easiness.

A still related another object of the present invention is to provide an electromagnetic relay which is easy to assemble and still high operational performances can be maintained for long.

A further related object of the present invention is to provide an electromagnetic relay whch can be effectively minimized in size and yet high and reliable operational performances are stably maintained.

Other objects and advantages of the present invention will be made clear in the following descriptions detailed with reference to certain preferred embodiments of the invention shown in accompanying drawings in which:

FIG. 1 is a perspective view showing schematically a typical arrangement in one of switching sections in conventional electromagnetic relays;

FIG. 2 is an explanatory view for a reason why a pair of fixed contact terminals cannot be provided as opposed in the relay of FIG. 1;

FIG. 4 is an equivalent electric circuit of the relay shown in FIG. 3;

FIG. 10 is an equivalent electric circuit of the relay shown in FIG. 9;

FIGS. 11A and 11B are respectively a plan view and a side view of an embodiment of coil bobbin employed in the relay of FIG. 9;

Figure 3:
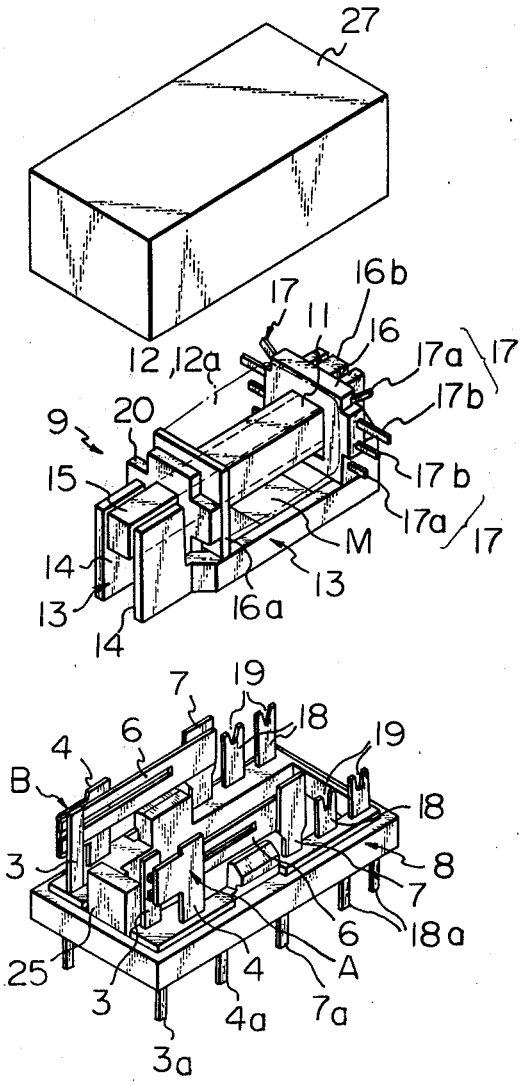
FIG. 3 is a perspective view of an embodiment of an electromagnetic relay in 2T type according to the present invention as disassembled into a cover, electromagnet block and electric switching block.
Figure 5A:
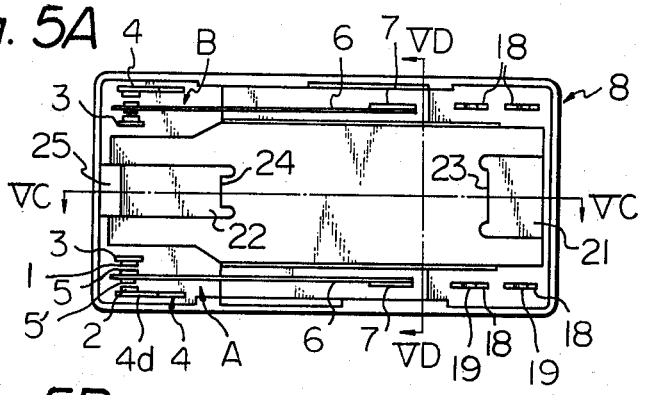
FIGS. 5A through 5D are a plan view, side view, longitudinally sectioned view on line VC—VC in FIG. 5A and cross sectional view on line VD—VD in FIG. 5A, respectively, of the electric switching block shown in FIG. 3.
Figure 5B:
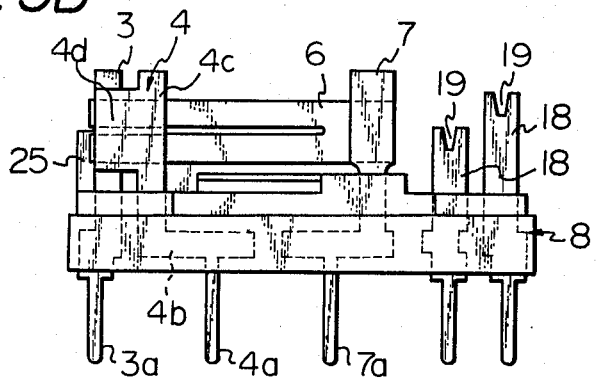
Figure 5C:
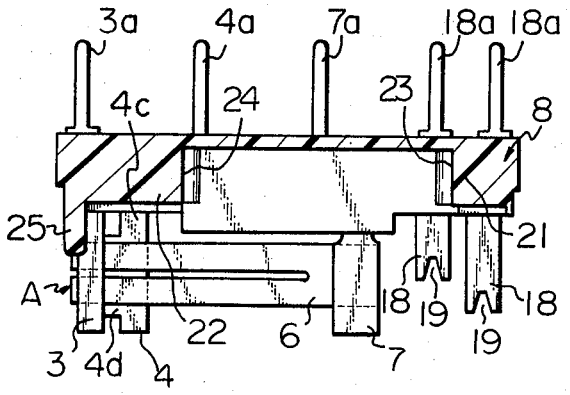
Figure 5D:
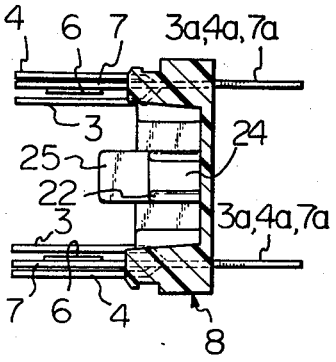

While the present invention shall now be explained with reference to the preferred embodiments shown in the drawings, it should be appreciated that the intention is not to limit the invention to the particular embodiments but rather to include all possible alterations, modifications and equivalent arrangements possible within the scope of appended claims.

Referring to FIGS. 3 to 5 showing an embodiment of the present invention in the case of 2T type polarized electromagnetic relay, an electric switching block comprises two switching or transfer sections A and B respectively including a pair of fixed contacts 1 and 2 respectively secured adjacent one end of respective fixed contact terminals 3 and 4, a movable contact spring plate 6 carrying on both surfaces at one end a pair of movable contacts 5, 5' and a movable contact terminal 7 securing the other end of the plate 6, and these two sections A and B are disposed on the upper surface of an insulative base 8 respectively adjacent each side edge while passed through the base so as to project respective terminal pins 3*a*, 4*a* and 7*a* at the other end of the respective terminals 3, 4 and 7 out of the other lower surface of the base. The fixed contact terminal 4 in each of the switching sections A and B is formed to be substantially in a reverse Z-shape as shown in FIG. 5B, as angled at intermediate portion 4*b* perpendicular to the lower end pin 4*a* and the other upper end 4*c*. In the present instance, the upper end 4*c* disposed above the upper surface of the base 8 as erected vertically therefrom has an integral extended portion 4*d* and, while the upper end 4*c* itself is positioned as spaced from the other fixed contact terminal 3 in the direction along the side edge of the base 8, the extended portion 4*d* is disposed to oppose the upper end of the other terminal 3 in the direction transversing the both side edges as seen in FIG. 5A. In order to have the opposing terminal 3 and extended portion 4*d* spaced from each other by a predetermined distance for movably inserting between them the one end carrying the movable contacts 5, 5' of the movable contact spring plate 6, at least one of the terminals 3 and 4 is bent at the intermediate portion embedded in the base, while the terminal pin 3*a* or 4*a* is preferably disposed in alignment with the other in the direction of the side edge. If, for example, the substantially Z-shaped terminal 4 is sufficiently bent twice for a length corresponding to the predetermined space preferably at the pin 4*a* immediately below the perpendicular intermediate portion 4*b*, the extended portion 4*d* may be omitted so that the entire upper portion 4*c* will be disposed to oppose the other terminal 3. In either case, the substantially reverse Z-shaped terminal 4 can be prepared in a common metal plate with the other fixed contact terminal 3 and movable contact terminal 7 as will be referred to later.

An electromagnet block 9 for driving the respective movable contact spring plates 6 in the two switching sections A and B is mounted on the upper surface of the base 8 and between the respective switching sections A and B. This electromagnet block 9 comprises a coil bobbin 11, a coil divided into two sections 12 and 12*a* in the present instance and would on the bobbin 11, a pair of yokes 13 substantially parallelly extending along and below the coil 12, 12*a* while coupled respectively at the intermediate position to respective different pole surfaces of a permanent magnet M disposed below the coil so as to form a magnetic gap by respective ends 14 of the yokes 13 at one end of them and disposed as opposed each other at one axial end of the coil, and an armature 15 passed through the coil bobbin 11 to dispose an end in the magnetic gap of the yokes and pivotably held at the other end by the other axial end of the bobbin 11 so that, upon an excitation of the coils 12 and 12*a*, the end disposed in the magnetic gap will be alternately attracted to either of the oppositly polarized ends 14 of the yokes 13. At both ends of the coil bobbin 11, there are provided flanges 16 and 16*a*, the flange 16 at the end which pivotably holding the other end of the armature 15 is made to be relatively thicker than the other flange 16*a*, a pair of coil lead terminals 17 respectively formed substantially in an U-shape are embedded at their bent part in each of both lateral side edges of the thicker flange 16 so as to project their both ends 17*a* and 17*b* out of the side edges, as seen best in FIG. 7B, and both end leads of the respective coil sections 12 and 12*a* are connected to the respective projected ends 17*a* of the terminals 17 on the both side edges of the flange 16. The other projected ends 17*b* on each side edge of the flange 16 are made relative longer than the ends 17*a* and are connected to respective upper ends of a pair of coil terminals 18 provided in each of the switching sections A and B of the switching block as also integrally embedded in the base 8 so as to project their terminal pins 18*a* at the other lower end out of the lower surface of the base 8. Preferably, the upper ends of the coil terminals 18 are provided respectively with a notch 19 so that the longer projected ends 17*b* of the coil lead terminals 17 will be inserted in the respective notches 19 of the coil terminals 18 to be connected therewith simultaneously with the mounting of the electromagnet block 9 on the base 8 of the switching block. An electrically insulative and non-magnetic card 20 having lateral side arms is fitted to the armature 15 adjacent its end inserted in the magnetic gap of the yokes 13 so as to engage the arms with the respective movable contact spring plates 6 when the block 9 is mounted on the switching block, whereby the alternate attracted movements of the armature 15 are transmitted to the spring plates 6 to change over the movable contacts from the NC side fixed contacts to the NO side fixed contacts in the respective switching sections A and B.

For the mounting of the electromagnet block 9 on the base 8 of the switching block, the base 8 is provided along the longitudinal axis in the space between the both side edges with a pair of bosses 21 and 22, vertical recesses 23 and 24 made on opposing surfaces of the bosses 21 and 22 and upward projection 25. The recess 23 and 24 are made at positions corresponding to the respective flanges 16 and 16*a* of the bobbin 11 and downward projections 16*c* and 16*d* made on these flanges are fixedly inserted into the recesses 23 and 24 when the electromagnet block 9 is mounted, and the upward projection 25 has a width corresponding to the predetermined magnetic gap distance of the yokes 13 so that the respective ends 14 of the yokes will be butted against both side surfaces of the projection 25 to be thereby positioned to define the gap. Accordingly, the electromagnet block 9 can be automatically fixed and positioned with respect to the switching block when the same is fitted to the upper surface of the base 8. After the longer ends 17*b* of the coil lead terminals 17 are connected to the coil terminals 18 in the thus fixed position of the block 9, a covering case 27 is fitted over the electromagnet block 9, respective switching sections A and B and coil terminals 18 to the base 8.

Figure 6A:
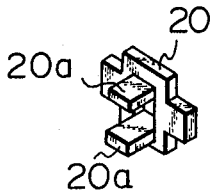
FIGS. 6A and 6B are perspective views respectively of a card member employed in another embodiment the relay according to the present invention and of the entire electromagnet block with the card assembled.
Figure 6B:
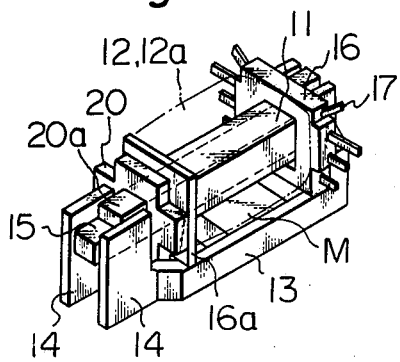

In FIGS. 6A, 6B another embodiment of the electromagnet block 9 is shown, wherein the card 20 is provided with endwise projections 20*a* to be positioned above and below the armature 15 and inserted in the magnetic gap. Since these projections 20*a* are made to have a width slightly longer than that of the armature 15, the end of the armature positioned in the gap is prevented from completely abutting either one of the opposing polarized surfaces of the yoke ends 14 so that a residual clearance will be provided between the respective yoke ends 14 and the armature 15, whereby separations of the armature from the yoke ends are made easier in the initial stage of the magnetic attraction for the switching operation.

Figure 8:
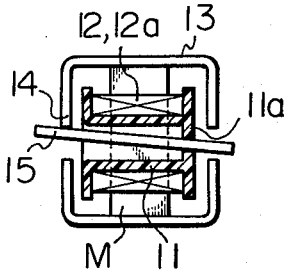
FIG. 8 is a schematic plan view with a part in section of an embodiment of electromagnetic device to be employed in the relay of FIG. 3.

FIG. 8 shows a further embodiment in which the coil bobbin 11 in the electromagnet block 9 is provided on the inner periphery at the end having the thicker flange 16 with a pair of opposing projections 11*a* so as to pivotably hold the armature 15. Usually, the other end of the armature 15 than the end inserted in the magnetic gap is held between the other yoke ends than the gap forming yoke ends 14, in which case the other armature end is caused to rock between the other yoke ends upon electromagnetic operations of the armature 15, whereby frictional wears of the both metal made armature and yokes are caused to occur so as to have operational characteristics of the electromagnet block deteriorated. In the present embodiment, the armature is held by the coil bobbin made of non-metallic insulative material, preferably high in the durability against frictions, so that the frictional wear can be effectively prevented and the other yoke ends can be terminated as slightly spaced from the armature end.

Figure 7A:
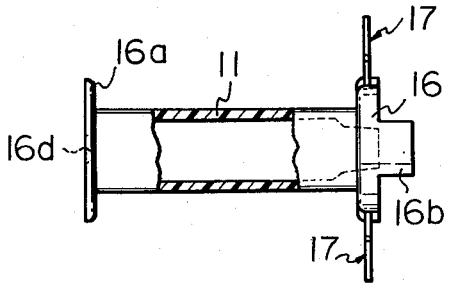
FIGS. 7A and 7B are respectively a plan view and a side view of a coil bobbin employed in the relay shown in FIG. 3.
Figure 7B:
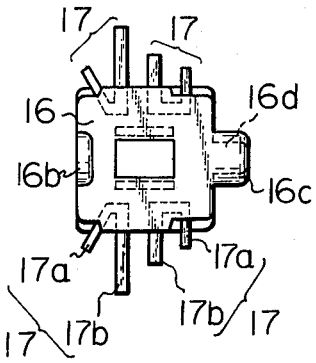
Figure 9:
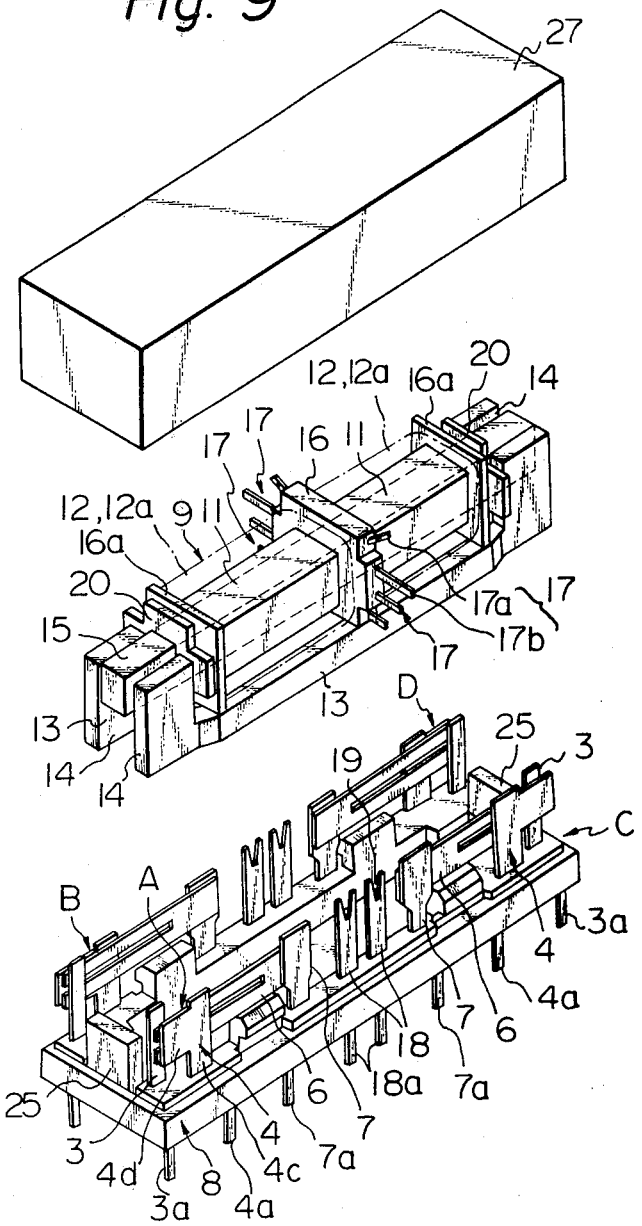
FIG. 9 is a perspective view of a 4T type electromagnetic relay having the similar arrangement as the relay of FIG. 3 also as disassembled into a cover, electromagnet block and switching block.
Figure 12:
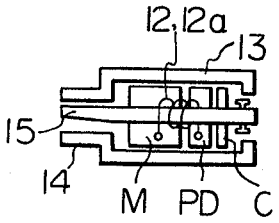
FIG. 12 is an explanatory plan view of an embodiment of electromagnetic device employed in the relay of 2T type of the present invention.
Figure 13:
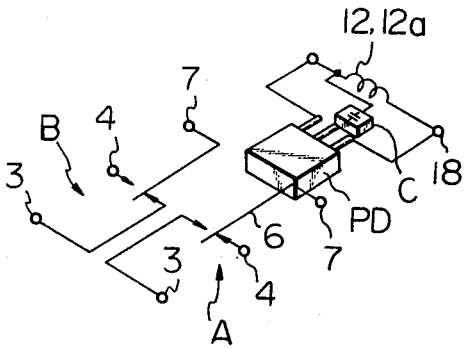
FIG. 13 is a schematic electric circuit of the relay employing the device of FIG. 12.

FIGS. 9 to 11 show an electromagnetic relay of 4T type arranged according to the foregoing embodiment of FIGS. 3 to 5. In the present case, as will be clear from FIG. 9, four switching sections A–D respectively arranged in the same manner as in the case of the foregoing embodiment are provided at each corners of the base 8 of the switching block which is elongated about double in the longitudinal direction. The switching sections A and B form one terminal assembly at one end of the base 8, and the remaining two switching sections C and D form another terminal assembly at the opposite end of the base 8. The respective terminals 3, 4 and 7 in the sections C and D are arranged in symmetrical relation to those in the sections A and B with respect to the coil terminals 18, and the base 8 is provided with another projection 25 for the magnetic gap position between the sections C and D also symmetrically with the foregoing projection 25 between the sections A and B, while the boss 21 and its vertical recess 23 are omitted. In the electromagnet block 9, the coil bobbin 11, coils 12 and 12*a* and card 20 are also provided symmetrical with respect to the thicker flange 16, the yorks 13 are elongated about double so as to provide a pair of magnetic gaps at respective both ends 14, and the armature 15 also double lengthened is inserted through the bobbin 11 as rockably held by the inner peripheral opposing projections of the centrally disposed thicker flange 16 so as to insert the both ends on the respective both end magnetic gaps, so that the armature 15 will be driven by coil excitations on both sides of the central flange 16 so as to perform a seesaw movement at the respective ends in opposite directions and simultaneously engage two of the movable spring plates (i.e., one spring plate of one of the terminal assemblies and one spring plate of the other terminal assembly) and drive those movable contact spring plates 6 also in the opposite directions. The electric connection in this embodiment of the 4T type is shown in FIG. 10. In the present instance, the coil bobbin 11 is provided at the both end flanges 16*a* with the downward projections 16*d* for inserting in the respective vertical resses 24 in the bosses 22 made adjacent the both ends of the base 8 to thereby fix the block 9 to the base. The central thicker flange 16 having the coil terminals 17 arranged in the same manner as in the foregoing case of FIG. 7 is provided with a peripheral notch 16*e* for allowing coil forming wire to pass therethrough so as to be able to wind the respective coils on both sides of the central flange 16 continuously.

Figure 14:
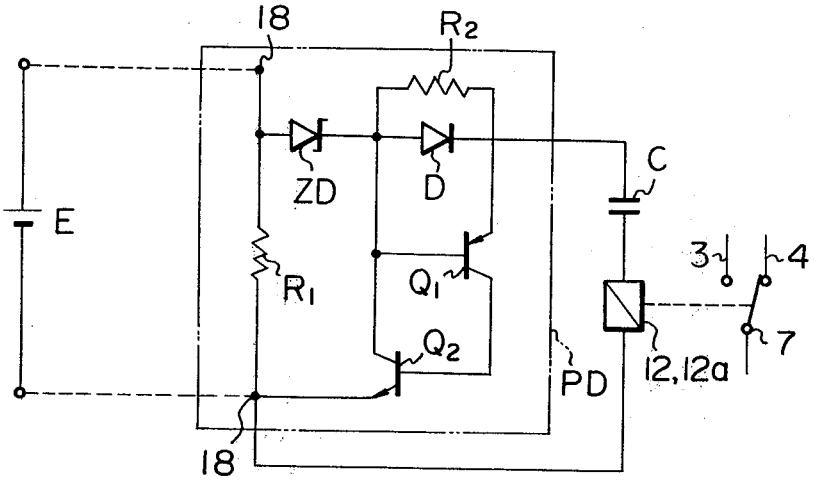
FIG. 14 is a circuit diagram a pulse drive circuit in the device of FIG. 12.
Figure 15:
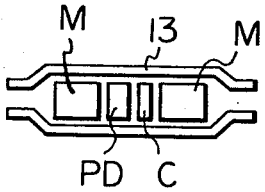
FIG. 15 is a plan view similar to FIG. 12 but in the case of 4T type relay.

FIGS. 12 through 15 show a further embodiment of the present invention relative to a driving circuit for the electromagnetic device in the block 9. It has been known in bistable type electromagnetic relays to drive the armature by an externally provided pulse driving circuit generating normal and reverse pulses for driving the armature only at the time of driving and resetting the armature, so as to reduce heat generation and required power occurring when the power must be continuously fed during the operation. The present invention employs such pulse driving circuit minimized in size and incorporated inside the relay without enlarging the entire relay dimensions nor the required power. A pulse driving circuit PD is a discharge circuit comprising, as shown in FIG. 14, a switching element $Q_1$ and $Q_2$, diodes D and ZD and resistors $R_1$ and $R_2$, which is formed in a small size integrated circuit, and is housed in a space between the respective yokes 13 on one side of the permanent magnet M as connected at two terminals with the coil terminals 18 of the both ends of the coil and at the other terminal with a charging and discharging capacitor C connected in turn to an end of the coil and also housed between the space between the yokes. The permanent magnet M is formed of a proper material for reducing the size but maintaining required magnetic property so that the required space between the yokes can be well attained without reducing the winding number of the coil. In the case of the 4T type relay, a pair of the magnet M are employed to provide a central space for housing the capacitor C and circuit PD between the respective yokes as shown in FIG. 15.

According to the present invention, as has been described, a pair of the fixed contact terminals are arranged in mutually opposing relation to each other at least at their parts carrying the fixed contacts in the respective switching sections the terminals of which are embedded in an array along the respective side edges of the insulative terminal holding base of the electromagnetic relay of the kind referred to while the terminal pin ends of these fixed contact terminals are held by the base substantially at the positions out of the opposing relation. Accordingly, it is made possible to secure a pair of the movable contacts to the movable contactor spring plate at the same distance positions on the both surfaces of the plate from the end at which the plate is fixed to the movable contact terminal, so that the same resiliency constant of the movable contact spring plate can be obtained for the both of the movable contacts on the both surfaces of the spring plate, whereby the same contacting pressure can be achieved on each of the NO and NC side positions of the movable contacts. The disposition in the out of opposing relation of the vertically erected upper end part of one of the fixed contact terminals with respect to the other allows the side cores of the molding die to reach the other fixed contact terminal, whereby substantially the same side cores as in the conventional case of FIG. 1 is made utilizable in molding the insulative base. Since the terminal pin ends of the fixed contact terminals are positioned out of the opposing relation, further, all of the terminal pin ends of the respective terminals 3, 4, 7 and 18 can be positioned substantially in an array, the space between the respective switching sections A and B (2T type) or A,C and B,D (4T type) is made simpler and opened wider, whereby it becomes possible to employ the upper die easily adapted to such space for molding the base 8 in conjunction with a lower die and both lateral side cores, except for the fixed contact opposing gaps, to easily provide in the upper surface of the base the respective means 21 to 24 for fixedly mounting the electromagnet block 9 onto the base and the means 25 for defining the magnetic gap distance of the yoke ends 14 and, accordingly, to render the manufacturing of the switching block as well as the assembly thereto of the electromagnet block easier and reliable. In this connection, it is further made possible that, in a simpler and more compact formation of the electromagnet block which are achievable in adaption to the simpler and wider space of the switching block, the electromagnet block can be easily provided with the residual-gap-defining projection 20*a* at one end of the armature, with the other yoke-end-spacing projection 16*b*, with the pulse driving circuit PD in the space between the yokes, with the pivotably armature holding projections 11*a* in the coil bobbin, and so on, so as to render the performances of the entire relay to be remarkably improved.

What is claimed is:

1. An electromagnetic relay comprising:

a switching block including an insulative base and at least two sets of terminal means, each set of terminal means comprising:

a pair of fixed contact terminals each carrying a fixed contact, and a movable contact terminal from which a resilient movable contactor extends between said pair of fixed contacts, said sets of terminal means being integrally held by said base along a respective side edge of said base, said pair of fixed contact terminals of each said set being in opposed relation to each other at their ends carrying said fixed contacts, while disposed out of said opposed relation at their ends embedded in said base, and an electromagnetic block mounted on said switching block and including:

an elongated magnetic circuit forming at least one magnetic gap at one longitudinal end, exciting coil means including a bobbin of non-metallic insulative material and a coil winding on said bobbin, one end of said bobbin including non-metallic insulative projections extending toward one another, and an armature having one end disposed between said projections and held thereby for rocking movement such that another end of said armature reciprocates within said gap, said armature arranged to selectively engage one of said resilient contactors when rocked by said coil means to move said engaged contactor from one position to another relative to the associated fixed contacts.

2. A relay according to claim 1 wherein said projections of said bobbin are formed of an anti-friction material.

3. An electromagnetic relay comprising:

an electromagnetic block including:

an elongated magnetic circuit forming magnetic gaps at both longitudinal ends thereof, an armature rockably supported at its center to dispose both its ends in said gap, and an exciting coil means arranged to rock said armature about its center so that both ends of said armature reciprocate in their respective gaps, and a switching block including an insulative base having two opposite ends, both of said last-named ends carrying terminal assemblies, each terminal assembly comprising two sets of terminal means, each set comprising:

a pair of fixed contact terminals each carrying a fixed contact, and a movable contact terminal from which a resilient movable contactor extends between said pair of fixed contacts, each of said sets of terminal means being integrally held by said base respectively along a side edge of said base, said electromagnetic block mounted on the base of said switching block with said armature arranged to simultaneously engage one resilient contactor of each said assemblies when rocked by said coil means to move said simultaneously engaged contactors from one position to another relative to the associated fixed contacts, said pair of fixed contact terminals of each said set being in opposed relation to each other at their ends carrying said fixed contacts, while being disposed out of said opposed relation at their ends embedded in said base.

4. A relay according to claim 1 wherein respective said terminals of respective said sets of a given terminal assembly substantially being aligned with each other along each of said side edges of said base.

5. A relay according to claim 1 wherein said magnetic circuit of said electromagnet block includes a pair of said magnetic gaps at both longitudinal ends, said armature is rockably held at the center so as to dispose both ends in respective said pair of magnetic gaps, and said two sets of respective said terminals are provided on both longitudinal endwise parts of said base so that two of said movable contactors in the respective sets will be simultaneously operated by said both ends of the armature.

6. A relay according to claim 1 wherein said coil means of said electromagnet block comprises a bobbin and a coil wound on said bobbin, both end flanges of the bobbin are provided respectively with a projection, and said base of said switching block is provided in a surface on which respective said terminals project with a pair of recesses opened in the same direction as that in which the terminals projects for fitting therein said projections of the bobbin.

7. A relay according to claim 1 wherein said magnetic gap is formed by a pair of opposing ends of two parallelly disposed yokes polarized by a permanent magnet interposed between said yokes, and said base of said switching block is provided with a projection fitting into said gap between said yoke ends and having a width corresponding to a desired magnetic gap distance for positioning the gap when the electromagnetic block is assembled to the switching block.

8. A relay according to claim 1 wherein said coil means comprises a bobbin having two end flanges and a coil wound on said bobbin, said magnetic circuit comprises a pair of yokes extending in the longitudinal direction of the bobbin as polarized by a permanent magnet interposed between said yokes and forming said magnetic gap by one end of the respective yokes opposing each other, and one of said flanges of the bobbin on the side of the other opposing ends of the yokes is provided with a projection inserted between said other ends of the yokes for positioning them.

9. A relay according to claim 1 wherein said armature carries a non-magnetic card for operating respective said movable contactor, and said card is provided with a projection extending into said magnetic gap and having a width slightly larger than that of the armature for providing a residual clearance between said one end of the armature and respective pole surfaces forming the gap.

10. A relay according to claim 3 wherein said coil means comprises a bobbin having a central flange and two end flanges, and coils wound on said bobbin between said central flange and respective said both end flanges, and said central flange has a peripheral notch for passing coil wire so as to allow said coils wound continuously through said notch.

11. A relay according to claim 6 wherein one of said bobbin flanges on a side opposite said magnetic gap is provided with at least a pair of coil lead terminals for connecting therethrough respective ends of said coil to said coil terminals of said switching block, said lead terminals are respectively formed substantially in a U-shape, bent part of respective said U-shape terminals being embedded in said one flange, one of extended ends of the respective U-shaped terminals is connected to one of the coil ends and the other end is connected to the coil terminal.

12. A relay according to claim 10 wherein said central flange of said bobbin is provided with at least a pair of substantially U-shaped coil lead terminals respectively embedded at bent part peripherally in the flange and extended at both ends, one of said extended ends is connected to one end of said coil and the other extended end is connected to said coil terminal of said switching block.

13. A relay according to claim 7 wherein said electromagnet block further comprises a pulse driving circuit comprising a charging and discharging capacitor and a discharging circuit including a switching element, at least said capacitor and switching element being connected in series with said coil for feeding the coil a normal pulse and reverse pulse alternatively, and said pulse driving circuit is disposed in a space between said pair of yokes in which said permanent magnet is disposed.

* * * * *